United States Patent [19]

Adkins

[11] 4,373,327

[45] Feb. 15, 1983

[54] GAS TURBINE ENGINE COMBUSTION CHAMBERS

[75] Inventor: Richard C. Adkins, Milton Keynes, England

[73] Assignee: Rolls-Royce Limited, London, England

[21] Appl. No.: 163,481

[22] Filed: Jun. 27, 1980

[30] Foreign Application Priority Data

Jul. 4, 1979 [GB] United Kingdom ..... 7923319

[51] Int. Cl.[3] ..... F02C 3/14

[52] U.S. Cl. ..... 60/39.37; 60/751

[58] Field of Search ..... 60/39.36, 39.37, 751; 415/207, DIG. 1

[56] References Cited

U.S. PATENT DOCUMENTS

| | | | |
|---|---|---|---|
| 2,556,161 | 6/1951 | Bailey et al. | 60/751 |
| 3,750,397 | 8/1973 | Cohen et al. | 60/39.36 |
| 4,194,359 | 3/1980 | Brookman et al. | 60/39.36 |

FOREIGN PATENT DOCUMENTS

| | | | |
|---|---|---|---|
| 1381149 | 10/1964 | France | 60/39.37 |
| 950935 | 2/1964 | United Kingdom . | |

*Primary Examiner*—Louis J. Casaregola

*Attorney, Agent, or Firm*—Cushman, Darby & Cushman

[57] ABSTRACT

In a gas turbine engine having a can annular combustion system, the diffusion passage between the outlet annulus of the engine compressor and the inlets to the individual combustion chambers located in an annular casing, is partially defined diffusion control housings, one of each of which is located adjacent the upstream end of the respective combustion chamber. Each control housing is wedge-like in planform and has a downstream recess to accommodate the dome-shaped head of the combustion chamber. The control housing increases in circumferential width and radial height in the downstream direction to reduce the diffuser area ratio. Scoops can be provided to guide primary and dilution air into each combustion chamber.

8 Claims, 7 Drawing Figures

GAS TURBINE ENGINE COMBUSTION CHAMBERS

Figure 1:
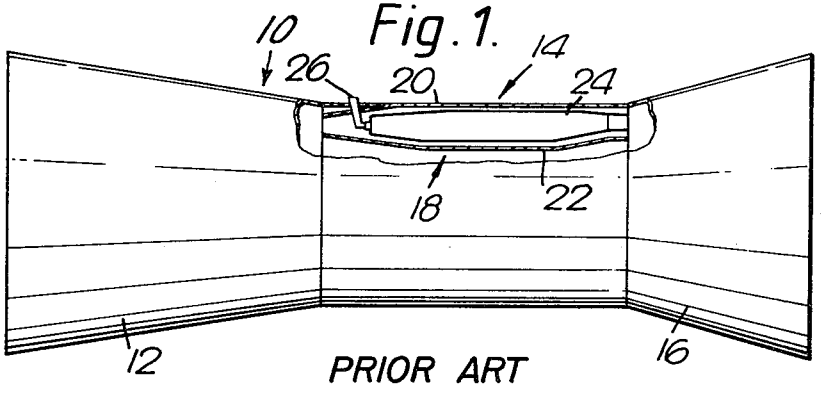
Fig. 1. PRIOR ART

This invention relates to combustion systems for gas turbine engines, more particularly combustion systems of the can-annular type i.e. a combustion arrangement which comprises, a circumferential array of flame tubes in an annular housing.

Such an arrangement can have many advantages over an annular system and in particular, it offers a superior aerodynamic array inside the flame tube because all the air jets enter radially and it offers a substantially lower development cost because only a fraction of the supply air is needed for testing. In practice however, the potential is hardly ever realised and mediocre combustion quality, together with lengthy development programmes are the normal experience.

The problem arises from the unsatisfactory condition of the flow between the individual flame tubes and the annular housing and here the distribution of supply air is far from uniform, regions occur where velocities are exceptionally high, and others, where the flow direction is completely reversed. Furthermore, a violent switching of the flow can develop between these regions. An unusually high pressure drop is required across the flame tube walls to provide accurate flow metering and to ensure combustion stability, so that the above conditions can be corrected. Such a high level of pressure drop would reduce engine efficiency and so the combustion quality has to be compromised.

The problem originates in the pre-combustor diffuser which, typically for can-annular systems, provides a near five fold increase in cross-sectional area in order to accommodate the combustion chambers. Invariably, the distance available for efficient diffusion is insufficient for such a large area increase and the diffuser flow breaks down. Large flow separations extend from near the diffuser inlet down into the annular housing, causing the detrimental flow conditions around the flame tubes. In addition to necessitating a large wall pressure drop, the bad diffuser flow generates a parasitic pressure drop, which is normally assigned to the combustion system as a whole.

On an aerodynamic basis, the diffuser area ratio need only be about 2:1 which, if operating effectively, will reduce the air velocity sufficiently for acceptance by low pressure drop combustion chambers. The length available in present day engines is nearly adequate for efficient diffusion over this lower area ratio, though the problem remains of uniformly distributing the air into the combustor without incurring any pressure loss due to the turning of the flow.

The present invention provides a form of combustion arrangement construction in which the diffuser casings are allowed to diverge so that there is a smooth transition between the outlet annulus of the engine compressor and inlet of the annular housing, the rapid increase in flow area being controlled by the provision of aerodynamically designed radial struts which extend between the walls of the annular housing and which have a progressive increase in cross-sectional area as they penetrate the diffuser. Thus the diffuser passage is increasing in radial height but decreasing in circumferential width, the overall effect being to decrease the diffuser area ratio and to produce efficient diffusion of the air from the engine compressor.

In plan, each strut appears as a wedge shape with its apex facing upstream and the base facing downstream.

The flame tubes can be located so that each tube is downstream and aligned with one of the wedges and in this manner the unstable wakes which would normally be shed from the bluff bases of the wedges are avoided. The air supply needed to feed the heads of the flame tubes with air can be delivered by the provision of plenum volumes immediately downstream of the wedge bases.

Also scoops, can be provided to guide the air flow into the plenum volumes and will also assist in further diffusing the airflow with only a minor pressure loss.

Figure 2:
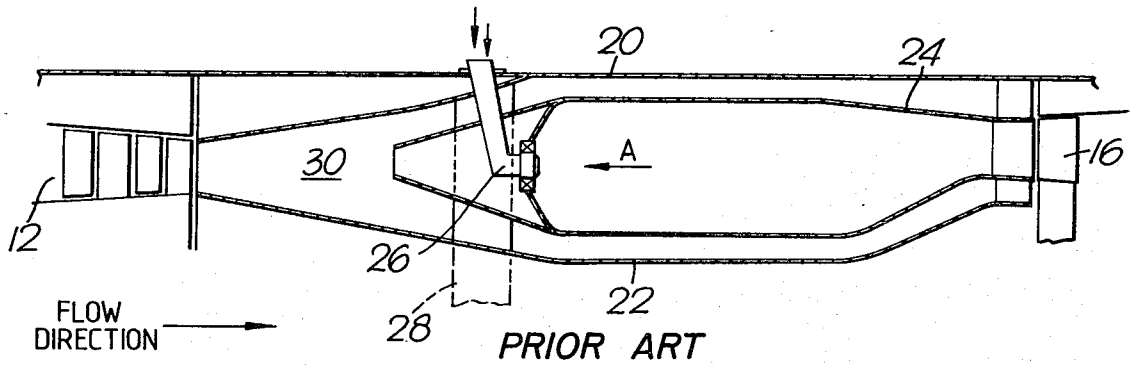
Fig. 2. PRIOR ART
Figure 3:
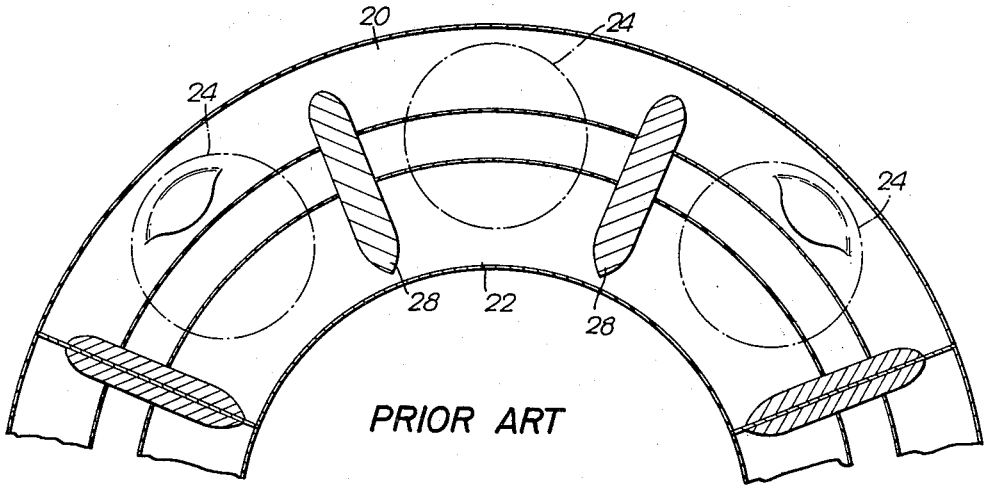
Figure 4:
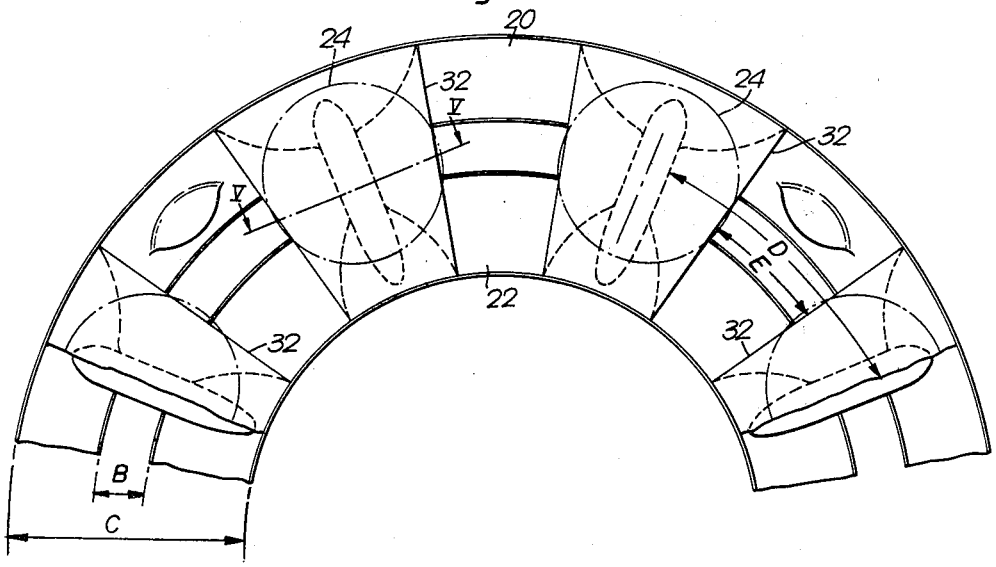
Figure 5:
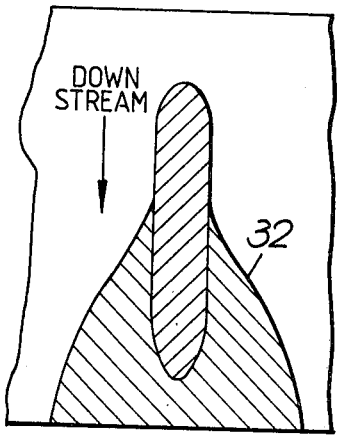
Figure 6:
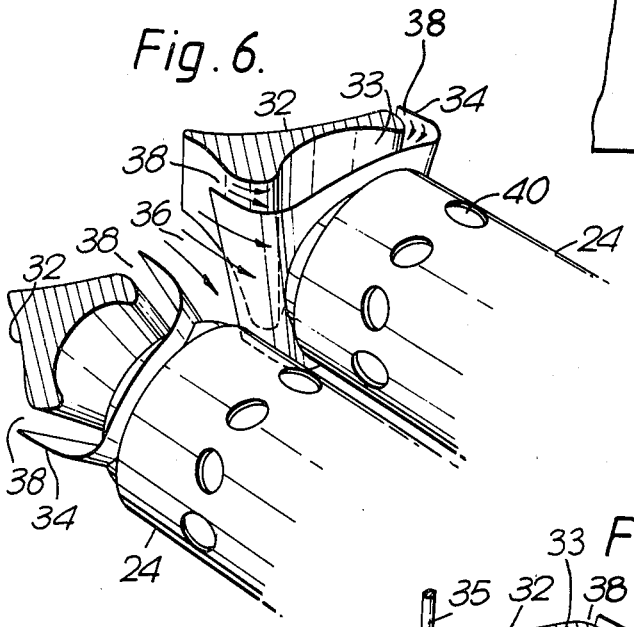
Figure 7:
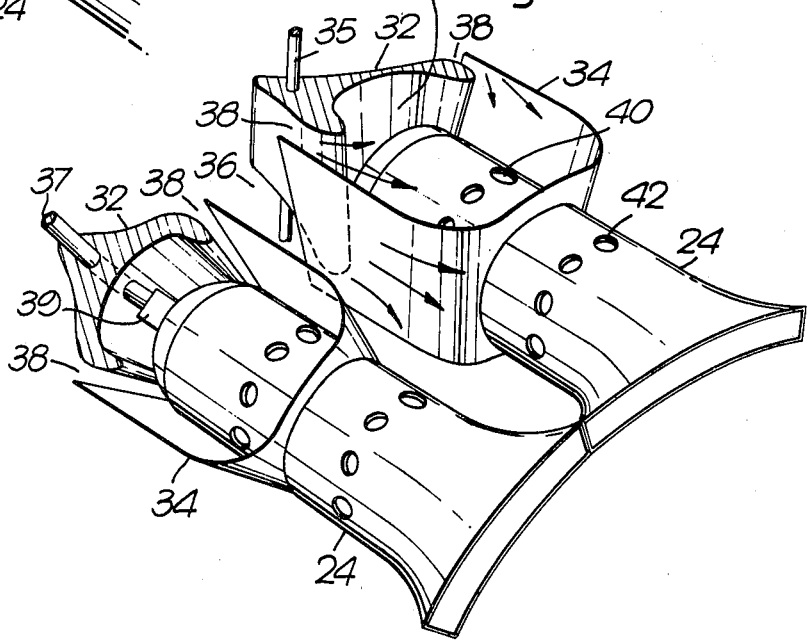

The present invention will now be more particularly described with reference to the accompanying drawings in which:

FIG. 1 is a diagrammatic representation of a gas turbine engine having a can-annular combustion system, FIG. 2 is a representation of the combustion system of FIG. 1 to a larger scale, FIG. 3 is a part view on arrow 'A' in FIG. 2, FIG. 4 is a view similar to FIG. 3 but showing a can-annular combustion system according to the invention, FIG. 5 is a section line V—V in FIG. 4, FIG. 6 is a perspective view of the combustion system of FIGS. 4 and 5, including diffusing scoops in a first position and, FIG. 7 is a view similar to that of FIG. 6 but showing the scoops in a second position.

Referring to FIGS. 1 to 3 inclusive, a gas turbine 10 has a compressor 12 supplying compressed air to a known form of can-annular combustion system 14, the hot exhaust gases from which drive a turbine 16, which in turn drives the compressor 12.

The combustion system 14 comprises an annular housing 18 having inner and outer walls 20, 22 and a plurality of circumferentially arranged equi-spaced flame tubes or combustion chambers 24, each having a fuel burner or injector 26. A load carrying strut 28 located between adjacent flame tubes extends from the outer wall 20 to the inner wall 22 and may extend to an inner structural part of the engine. The upstream ends of the walls 20 and 22 define a diffusion passage 30 for the supply air from the compressor 12.

Referring now to FIGS. 4 and 5 which illustrate the main aspect of the present invention, the diffusion passage 30 is modified as compared with FIGS. 1 to 3 in that, upstream and aligned with each flame tube, a wedge or aerodynamic strut 32, is located extending between the inner and outer walls 20, 22 and in the upstream-downstream direction. The aerodynamic struts 32 may be load bearing, thus permitting elimination of the struts 28 from the diffusion passage 30 between adjacent flame tubes 24, if desired. The plan section of the wedge or strut 32 is shown in FIG. 5 and it will be noted the strut 32 has an upstream apex and a downstream base spaced from the upstream end of the flame tube or combustion chamber 24. The base may be recessed as indicated at 33 (FIGS. 6 and 7) in a shape similar to the upstream end of the flame tube. The space between the base of the wedge or strut 32 and the upstream end of the combustion chamber 24 provides a plenum volume to receive the flow of compressed air for delivery to the combustion chamber. While the diffusion passage 30 is increasing in radial height, it is also decreasing in circumferential width because each wedge increases in cross-sectional area in the downstream direction and the radial height between the upstream ends of the walls 20, 22 increases. Thus in FIG. 4, the diffusion passage increases in radial height from dimension B to dimension C and decreases in the circumferential width from dimension D to dimension E. It will be appreciated that the wedges are designed according to the aerodynamic requirements of the diffusing passages causing them to have a lower area ratio than would otherwise be the case, without incurring unacceptable pressure losses.

As shown in FIGS. 6 and 7, in which the inner and outer walls 20, 22 are omitted for clarity, a scoop 34 can be attached around each flame tube and extend between the walls 20, 22 to form further diffusing passages 36, 38 between adjacent scoops 34 and between the scoops and the bases of the wedges respectively to guide the air into various parts of each flame tube 24. In FIG. 6, the scoops are arranged to guide the primary air into the head of each flame tube, while in FIG. 7, the scoops are located both to guide the primary air into the flame tube head and to guide the secondary air into the flame tubes through inlets 40. The scoops can also be located to guide the air flow into the flame tube through dilution ports 42.

Tests performed on a diffuser of the type shown in FIGS. 1 to 3 shows that the flow separated and was unstable.

With the wedge diffuser as shown in FIGS. 4 and 5, the diffuser flow was extremely stable, with strong flows along the sides of the wedges ideally suited to a second stage of diffusion through the scoops 34. Although the diffuser area ratio was now less than 2:1 as compared with over 4:1 without the wedges 32 the static pressure recoveries were greater compared with the standard diffuser with both uniform and non-uniform inlet profiles for flow distributions.

The wedge diffuser also favoured the more realistic non-uniform inlet profile in that a greater static pressure recovery coefficient was achieved.

The wedge diffuser according to the invention can give the following advantages:

the load carrying struts, usually found in the diffuser passage can be incorporated into the wedges, thereby leaving the diffusion passage aerodynamically clean and the larger cross-sectional area of the wedges will reduce the stressing problem normally encountered with the more slender struts, the wedge will contain sufficient space for services such coolant and lubricant lines 35 to be easily transferred between the exterior and interior of the engine, fuel lines 37 and burners 39 can be built into the wedges and space will be available if fuel and air premixing is required or if pre-evaporation of fuel is to take place, if the wedges are hollow, the flame tubes can be extended upstream into them and such an arrangement would be useful in staged combustion systems alternatively, a variable geometry system could be incorporated by using variable area diffusing scoops as a means of controlling the distribution of air between combustion and dilution air, the variation being made by using either mechanical or fluidic means in an acceptable environment.

The wedges have been shown, each aligned with a separate flame tube, but in some combustion systems, because of the areas involved, it may be necessary to provide a number of wedges which are either greater or less than the number of flame tubes, in which case the relative positions of the wedges, and flame tubes will be determined by the arrangement which gives the best aerodynamic conditions. Thus, the invention also comprises combustion systems in which the wedges are arranged between adjacent struts.

I claim:

1. A gas turbine engine combustion system comprising:

an annular housing defined by inner and outer annular walls;

a plurality of combustion chambers equi-spaced apart and circumferentially arranged within said annular housing, each of said combustion chambers having an upstream and a downstream end;

a diffusion passage upstream of the upstream ends of said combustion chambers, said diffusion passage including inner and outer annular walls connected respectively to said inner and outer annular walls of said annular housing, said inner and outer walls of said diffusion passage converging in an upstream direction and arranged to receive a flow of compressed air; and a plurality of aerodynamic struts extending between said inner and outer walls of said diffusion passage, each of said struts being adjacent to and upstream of and in alignment with a respective one of said combustion chambers, each of said struts being wedge-shaped in plan form and having an upstream apex, a downstream base spaced from the upstream apex of the respective one of said combustion chambers and sidewalls extending the full height of said diffusion passage, each of said struts having a circumferential width and radial height increasing from the apex thereof in a downstream direction to the base thereof whereby said diffusion passage increases in radial height and decreases in circumferential width in a downstream direction so as to decrease diffuser area ratio.

2. A combustion system as claimed in claim 1 in which the base of each aerodynamic strut has a recess corresponding to the shape of the upstream end of the respective one of said combustion chambers, the space between the upstream end of the combustion chamber and the recess being a plenum volume arranged to receive a flow of compressed air.

3. A combustion chamber as claimed in claim 1 in which each aerodynamic strut is a load carrying strut extending between the annular housing and a radially interior structural part of the gas turbine engine in which the combustion system is located.

4. A combustion system as claimed in claim 1 in which each one of the aerodynamic struts includes at least one fluid supply line.

5. A combustion system as claimed in claim 4 in which the fluid supply line comprises a fuel supply line.

6. A combustion system as claimed in claim 1 in which each of said combustion chambers includes an air scoop arranged to direct compressed air into a selected part of the combustion chamber.

7. A combustion system as claimed in claim 6 in which each of said combustion chambers is provided with a plurality of air inlets for secondary air, and in which said air scoop for each of said combustion chambers is positioned upstream of said air inlets and arranged to guide primary compressed air into the upstream end of the respective one of said combustion chambers.

8. A combustion system as claimed in claim 6 in which each of said combustion chambers is provided with a plurality of air inlets for secondary air and a plurality of ports for dilution air, and in which said air scoop for each of said combustion chambers is positioned intermediate said secondary air inlets and said dilution ports for guiding compressed primary air into the upstream end of the respective one of said combustion chambers and for guiding secondary air through said air inlets of the respective one of said combustion chambers.

* * * * *